United States Patent [19]

Ping

[11] 4,342,902

[45] Aug. 3, 1982

[54] AUTOMATIC CIGARETTE LIGHTING CASE

[76] Inventor: Wu Ping, c/o Nationwide Adv. Ag., 233 Broadway, Rm. 3615, New York, N.Y. 10007

[21] Appl. No.: 203,064

[22] Filed: Nov. 3, 1980

Related U.S. Application Data

[63] Continuation-in-part of Ser. No. 906,082, May 15, 1978, abandoned.

[51] Int. Cl.[3] ..... F23Q 7/16

[52] U.S. Cl. ..... 219/268; 219/261; 219/262; 219/267; 221/144

[58] Field of Search ..... 219/214, 260, 261, 262, 219/263, 267, 266, 268, 269; 221/144, 147, 148; 220/339; 312/86; 55/385; 206/85, 86

[56] References Cited

U.S. PATENT DOCUMENTS

| | | | |
|---|---|---|---|
| 2,002,492 | 5/1935 | Dess | 219/261 X |
| 2,226,250 | 12/1940 | Mayer | 219/267 X |
| 2,243,889 | 6/1941 | Shively | 219/261 X |
| 2,340,773 | 2/1944 | Shively | 219/261 |
| 2,535,665 | 12/1950 | Boyarsky et al. | 219/268 |
| 3,351,735 | 11/1967 | Desbiens | 219/261 |
| 3,361,894 | 1/1968 | Lester | 219/261 |
| 3,548,148 | 12/1970 | Kawashima | 219/262 |
| 3,769,492 | 10/1973 | Senkewich | 219/262 |
| 3,789,187 | 1/1974 | Brezina | 219/261 |
| 3,943,327 | 3/1976 | Vizelyi et al. | 219/261 |

*Primary Examiner*—Volodymyr Y. Mayewsky

[57] ABSTRACT

A cigarette case including a row of tubular sockets in which cigarettes are fitted, an electric circuit inside the case including a spiral heating coil positioned adjacent one end of each cigarette, the coil being mounted on a slide block having an externally extending push button which when pushed, pushes the cigarette end outwardly of an edge of the case, and at a same time slides the contacts of the coil into engagement with stationary contacts connected to dry cell batteries, so to heat the coil and thus ignite the cigarette as it is being pushed outwardly from the case.

3 Claims, 11 Drawing Figures

10
11
12
13
14
16
18
19
20
30
37
41
42
43
45
46

AUTOMATIC CIGARETTE LIGHTING CASE

This invention relates generally to cigarette dispensing cases, and the present application is a continuation in part of application Ser. number 906,082, filed, May 15, 1978, now abandoned, priority being claimed accordingly.

It is well known that conventional cigarette cases serve only to store cigarettes, and when a person wishes to smoke one, he must first remove it from the case and then pick up either a cigarette lighter or tear a match from a match book in order to provide a flame for igniting the cigarette. Thus in addition to handling the cigarette case, the person is also obliged to handle a separate means for igniting the cigarette taken from the case. This is time consuming, requiring special attention, and is old fashioned, so is in need of an improvement.

Therefore it is a principal object of the present invention to provide an improved cigarette lighting case which automatically dispenses a cigarette in an already ignited condition, thereby eliminating the need of carrying any extra lighter or matches, and saving the time and attention given for such distracting extra chore.

Another object is to provide an improved, automatic cigarette lighting case which additionally includes its own ash tray for use, in case no other ash tray is conveniently available for receiving the ashes from a burning cigarette.

Yet another object is to provide an improved, automatic cigarette lighting case that is operated by only a sliding of a push button that can be felt by a uses and needs not be seen, so that a person can obtain a lighted cigarette in a darkness such as inside a darkened theater or the like.

Figures 1, 2, 3, 4, 5:
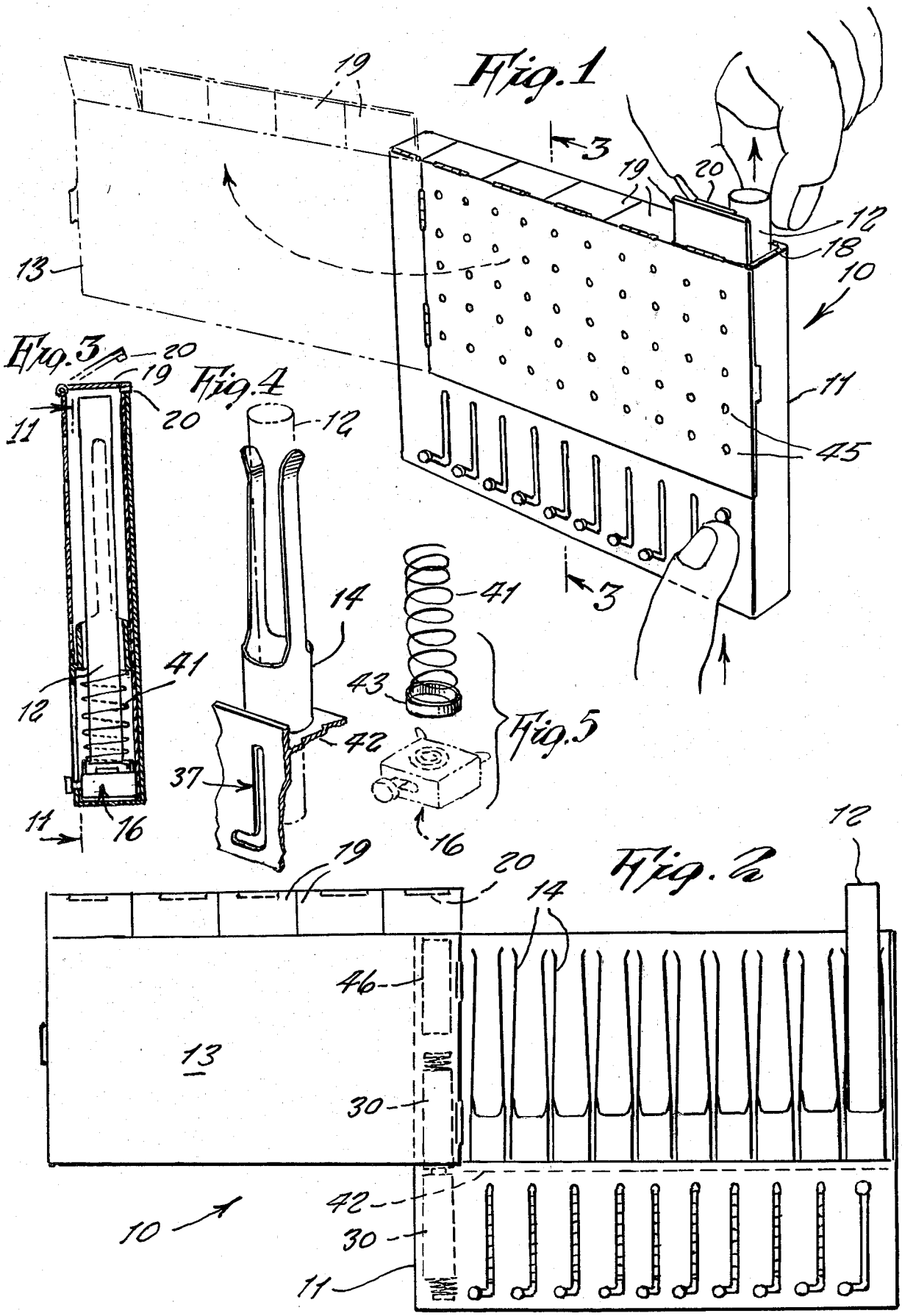
FIG. 1 is a perspective view of the improved, automatic cigarette lighting case being shown in use dispensing a lighted cigarette.
FIG. 2 is a front view thereof shown with front cover swinged open, such as when reloading the case with cigarettes.
FIG. 3 is a cross sectional view on line 3—3 of FIG. 1.
FIG. 4 is a detail perspective view of a transfer tube or clip in which each cigarette is stored.
FIG. 5 is a detail perspective view of a typical return spring mechanism for a sliding cigarette igniter.
Figure 6:
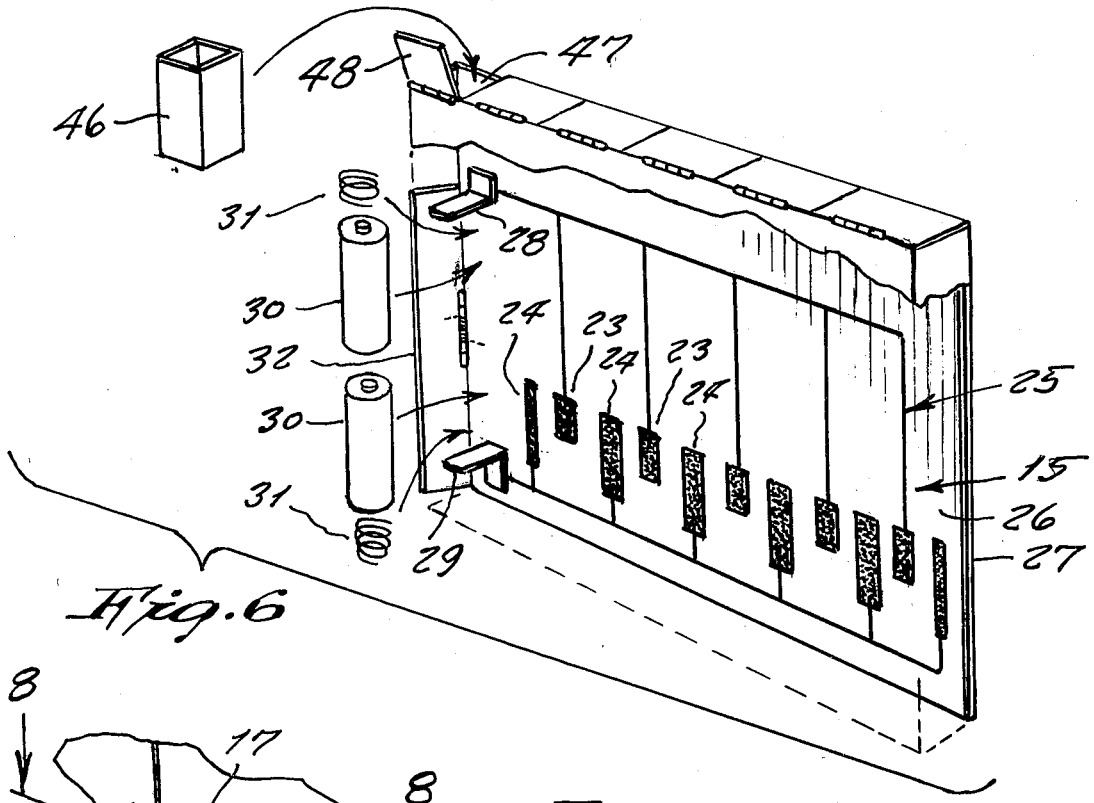
FIG. 6 is a fragmentary perspective view of the cigarette case showing the stationary portion of the electric circuit thereof.
Figure 7:
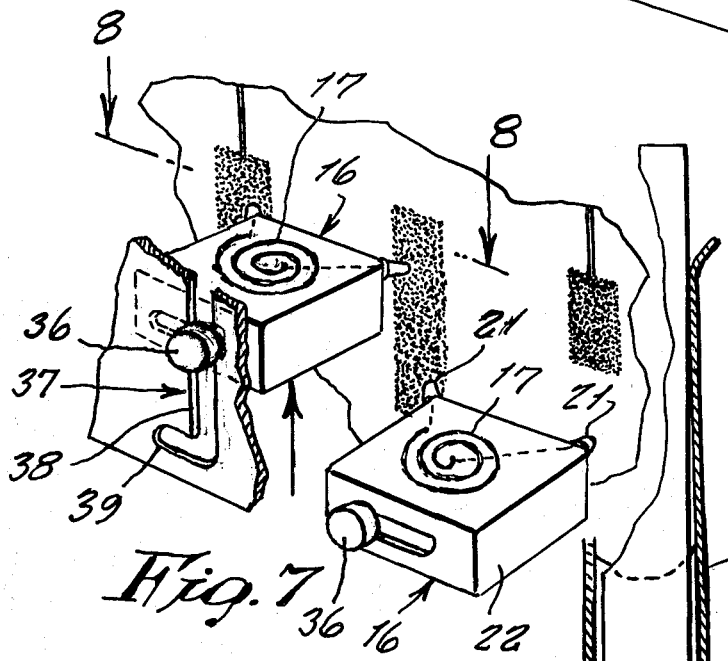
FIG. 7 is a perspective view showing the sliding igniters in relation to the stationary portion of the electric circuit.

Referring now to the drawings in greater detail, the reference numeral 10 represents an improved, automatic cigarette lighting case, according to the present invention, wherein there is a stainless steel case 11 for containing ten cigarettes 12. A pivotable hinged front door 13 provides easy access for reloading the cigarettes into transfer tubes or clips 14.

An igniting system 15 for automatically dispensing the cigarettes in a pre-ignited condition, ready for smoking, includes a igniter 16 positioned adjacent an end of the cigarette, and which includes an electric heating coil 17 that heats up while the igniter is used for pushing the cigarette out of a top opening 18 of the case. The opening 18 is normally retained closed by a row of hinged doors 19 each of which is held in closed position by a permanent magnet 20, and when a cigarette is being dispensed only one of the doors 19 is thus pushed open by the cigarette, while the other doors remain closed, as shown in FIG. 1.

The igniter heating coil becomes heated, while being pushed, by means of contacts 21 on the ends of the heating coil and protruding from igniter block or body 22 coming into contact with both positive and negative contacts 23 and 24 of a printed electric circuit 25 on an insulated surface or board 26 mounted on an inner side of the case rear wall 27, the circuit communicating with clips 28 and 29 between which replaceable dry cell batteries 30 are placed together with contact pressure springs 31. A hinged end edge door 32 allows access for replacement of the batteries when becoming worn out.

Figure 8:
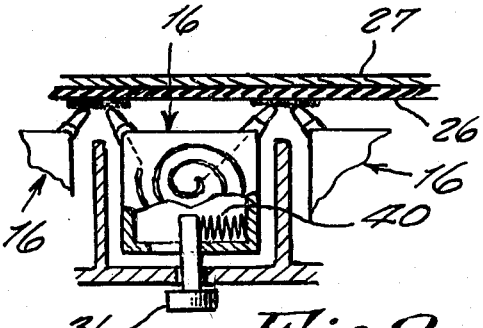
FIG. 8 is a view thereof as viewed on line 8—8 of FIG. 7.
Figure 10:
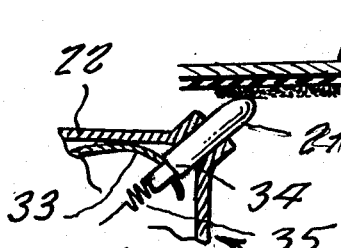
FIG. 10 is an enlarged detail cross sectional view taken on line 10—10 of FIG. 9 showing a typical contact construction.
Figure 11:
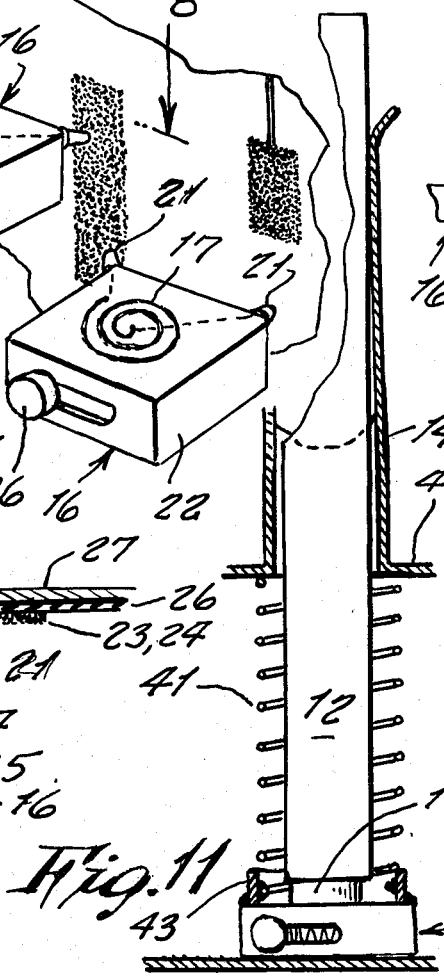
FIG. 11 is an enlarged cross sectional view on line 11—11 of FIG. 3.

As clearly shown in FIG. 8 each printed contact 23 and 24 is engaged by two contacts 21 of two adjacent igniters 16.

In order that a good connection is obtained between the contact 21 and either of the contacts 23 or 24, the contact 21 is urged to slide outwardly of the igniter block 22 by a leaf spring 33 bearing against a shoulder 34 of the contact 21. A few turns 35 at the ends of the heating coil 17 allow for the relative sliding the contact while maintaining electrical connection between the coil and the contact 21.

Each igniter includes a push button 36 extending outwardly of the case through a slot 37, in order to be manually pushed, as shown in FIG. 1 when a cigarette is wished to be dispensed.

Figure 9:
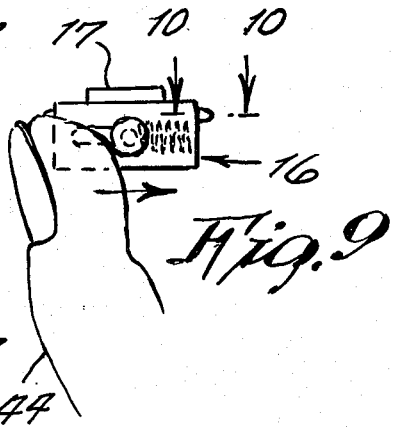
FIG. 9 is a front view of the igniter, shown with button being manually pushed sideward, in order to slide in the vertical leg of the slot, as shown in fufigure 7.

In order that no igniter may accidently slide and heat up the coil, except when so wished, each push button must first be sidewardly urged, as shown in FIG. 9, before it can travel along the long leg 38 of the slot. During this sideward travel, a stem of the pushbutton travels in a short leg 39 of the slot, and which is at right angle to the leg 38. In order to prevent the pushbutton accidently being sidewardly moved, a spring 40 inside the block 22 normally urges the push button to remain in the short leg 39.

Also for a double protection, a compression coil spring 41 between the igniter and a partition 42 of the case 11 normally urges igniter to not come into connection with the contacts 23 and 24 of the printed circuit. A ring 43 on an end of the spring 41 is affixed to the igniter block for preventing contact with the coil.

However, when a lighted cigarette is wished to be dispensed, the pushbutton is first sidewardly moved by a finger 44 so it may then travel in leg 38 of the slot. Thus the igniter can push the cigarette out of the case, and at a same time the coil is heated for igniting the cigarette. Rows of air holes 45 on the door 13 allow access of fresh air to the ignited cigarette so to prevent the light to go out while the cigarette lighted end moves through the case interior.

A handy ash tray 46 removably placed in a cavity 47 in one corner of the case, and closable by a hinged cover 48 on the case, serves as an emergency ash tray, if no other conventional ash tray is readily available for use, when needed by a smoker.

While various changes may be made in the detail construction, it is understood that such changes will be within the spirit and scope of the present invention as is defined by the appended claims.

What is claimed:

1. An improved, automatic cigarette lighting case, comprising in combination, a case, a front door hinged on said case for insertion of cigarettes therein when said door is open, a row of transfer tubes in said case, each said tubes receiving one of said cigarettes in an opening along an upper end edge of said case through which said cigarettes are dispensed into respective tubes a plurality of hinged covers closing said dispensing opening, said covers mounted on said door and means for said cigarettes being pre-ignited when dispensed into respective tubes wherein said means comprising a battery powered electrically insulated electric circuit and an electrically insulated sliding igniter coil adjacent the bottom end of each said tubes for igniting said cigarette.

2. The combination as set forth in claim 1 wherein each said coil is mounted upon a sliding support manually actuated that pushes said cigarette outward of said case, and means for said coil being electrically engaged with said circuit when said igniter is manually pushed outward, in further combination with a manual actuator attached to said support for pushing said support outward.

3. The combination of claim 2 wherein the last said means includes electric contacts connected to said coil that projects outward of said support, said contacts being movable to a position making electrical contact with said circuit when said support is pushed outwardly, including safety means to prevent premature ignition.

* * * * *